US005820401A

United States Patent [19]

Hasz et al.

[11] Patent Number: 5,820,401

[45] Date of Patent: Oct. 13, 1998

[54] WIRE GUIDE ASSEMBLY FOR USE WITH AN ELECTRICAL CONNECTOR HAVING A JACK SCREW

[75] Inventors: Richard Eric Hasz, Ramseur; Gary Ray Marpoe, Jr., Kernersville; Michael Dale Brown, Greensboro, all of N.C.

[73] Assignee: The Whitaker Corporation, Wilmington, Del.

[21] Appl. No.: 623,809

[22] Filed: Mar. 29, 1996

[51] Int. Cl.[6] ..... H01R 13/627

[52] U.S. Cl. ..... 439/364

[58] Field of Search ..... 439/364, 362

[56] References Cited

U.S. PATENT DOCUMENTS

| | | | |
|---|---|---|---|
| 3,803,530 | 4/1974 | Lapraik | 339/36 |
| 4,738,635 | 4/1988 | Harrington et al. | 439/452 |
| 5,183,420 | 2/1993 | Hollander et al. | 439/457 |
| 5,259,785 | 11/1993 | Inaba et al. | 439/364 |

*Primary Examiner*—Khiem Nguyen
*Assistant Examiner*—Yong Ki Kim

[57] ABSTRACT

A mated assembly (100) includes a sealed connector subassembly (10), a cap housing (20), a contact retention insert (30), a wire seal (40), a seal cover (50), a jack screw (60), and a header housing (70). Jack screw (60) is used to matably join the subassembly (10) with the header (70). Subassembly (10) comprises a cap housing (20) which includes a cavity (23) wherein the contact retention insert (30) is disposed along with a blanket type seal (40) for receiving electrical contacts that will electrically mate with respective pins of contact array (72). Wire guide (80) includes latching legs (89) for latchable engagement with wire guide mounts (29) of cap housing (20) thereby allowing proper wire guiding of the wires exiting from the subassembly (10). The wire guide (80) advantageously includes reinforcement structures (84,85) and a bolt access tower (83) for allowing an operator to operate jackscrew (60) with a tool.

18 Claims, 6 Drawing Sheets

WIRE GUIDE ASSEMBLY FOR USE WITH AN ELECTRICAL CONNECTOR HAVING A JACK SCREW

The present invention relates to a wire guide assembly for use with an electrical connector assembly; more particularly, the present invention relates to a wire guide which is latchable to the connector assembly and includes an access hole for permitting a tool to operate a connector mating mechanism of the connector assembly without disturbing wires connected to the connector assembly.

BACKGROUND OF THE INVENTION

Wire guides are typically used in the motor vehicle industry for the purposes of supporting and guiding a plurality of wires terminated to electrical connectors, for example, connectors and wires which comprise part of a motor vehicle wiring harness. Wire guides are essential in environments where machinery parts are in motion, for example, in the engine compartment of a motor vehicle. Improperly guided wires may become entangled in the moving machinery or engine parts and can be broken, or the entire wiring harness can be ripped apart in seconds. Wiring harness assemblies including wire guides should therefore be compact, and must reliably perform their function in spite of the harsh conditions associated with use in a motor vehicle engine compartment, namely, mechanical vibration, temperature/heat cycling, and/or corrosive chemical vapors, fluids, gasses and etc. Moreover, an engine mechanic must be able to service the electrical components to which the wiring harness is interconnected, but do so with a minimum of disassembly/assembly time and effort.

Conventional, off-the-shelf wire guides are not robust enough to withstand the harsh conditions of associated with use in a motor vehicle. For example, the wire guide disclosed in U.S. Pat. No. 3,803,530 is designed to guide wires at a generally 90 degree orientation, but the connector is made with thin plastic walls which are not likely to withstand vibration and temperature cycling. Moreover, because the conventional design requires screw fasteners to connect the guide to a housing, it is time consuming to assemble/disassemble. Additionally, the conventional connector does not provide a tool receiving access area for receiving a tool for operation of a connector mating mechanism. The conventional design is, therefore, intended for use in commercial or residential environments, and is not suited to the harsh environments associated with a motor vehicle engine compartment.

In view of the foregoing, what is needed is a mechanically robust and reliable wire guide for use with an electrical connector which is suitable for use in the harsh environments of a motor vehicle, is time-efficient to use when assembly/disassembly is necessary, but is manufactured at a low production cost.

SUMMARY OF THE INVENTION

The foregoing criteria are achieved by the present invention which comprises an electrical connector having a wire exit side, a fastener accessible from the wire exit side, and the connector comprises opposed latch receiving lugs for receiving respective wire guide latches; and a wire guide having latches extending therefrom for respective latching engagement with the connector latch receiving lugs, the wire guide comprises a fastener access aperture for permitting operation of the fastener when the wire guide is mounted on the connector.

The aperture comprises a conically shaped bolt access tower buttressed by a reinforcement section of the wire guide. Additionally, the wire guide comprises a transverse reinforcement section for grouping wires and stiffening the wire guide.

Each of the latches is deflected as it registers with a respective latch receiving lug, and each of the latches comprises respective inner and outer latching projections for latching registration with a respective latch receiving lug. Moreover, the connector comprises a cover member with notches formed adjacent to the latch receiving lugs, and the latches pass into the lugs adjacent the notches.

DETAILED DESCRIPTION OF THE INVENTION

Figure 1:
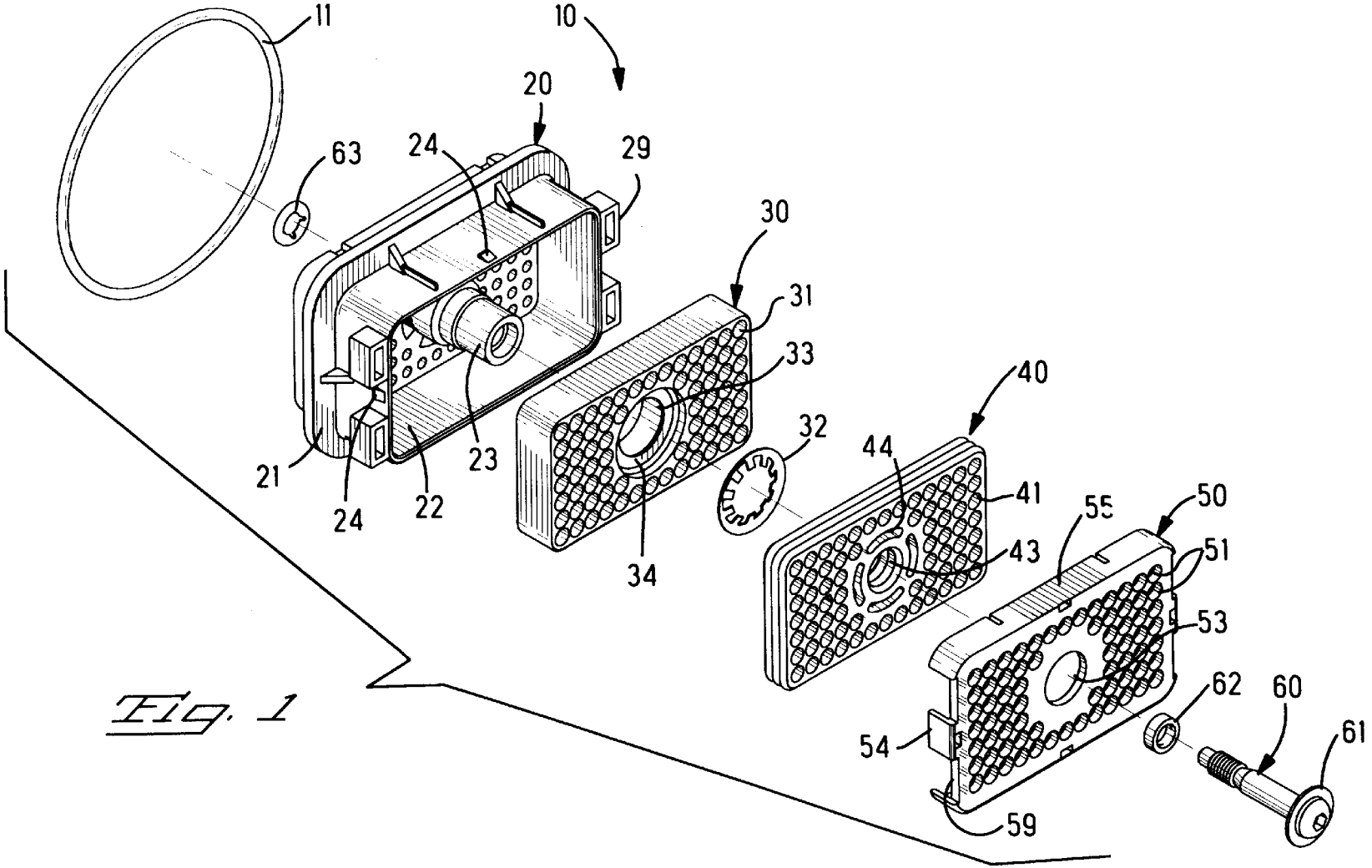
FIG. 1 shows an exploded isometric view of a connector subassembly according to the present invention.

Referring to FIG. 1, the sealed connector subassembly 10 of the present invention will be described. Sealed connector subassembly 10 comprises an interface seal 11, a plug housing 20, a contact retention insert 30, a wire seal 40, a seal cover 50, and a jack screw 60.

Figure 2:
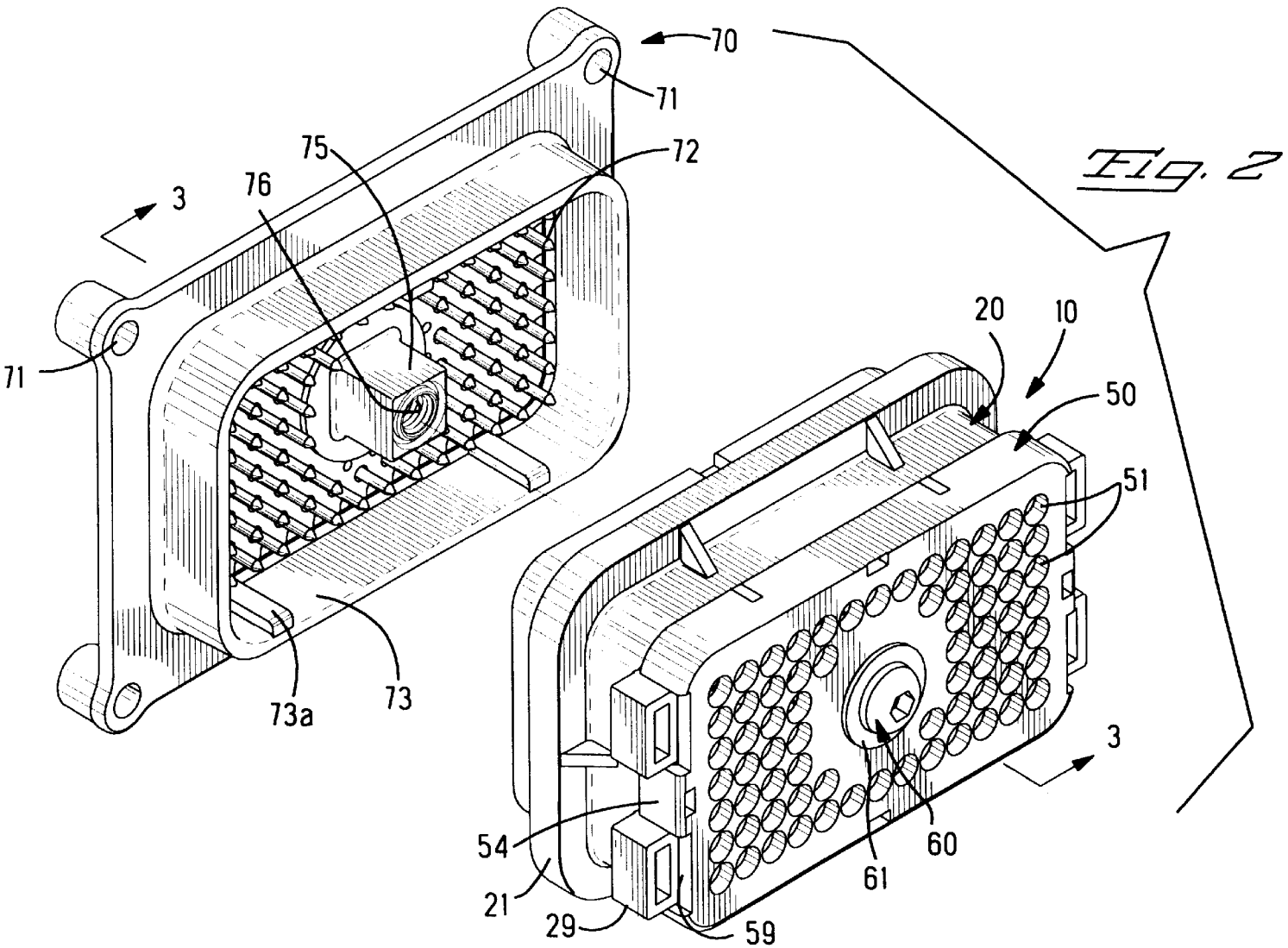
FIG. 2 shows the subassembly of FIG. 1 in a fully assembled state arranged to be connected to a matable connector comprising a contact pin array.
Figure 3:
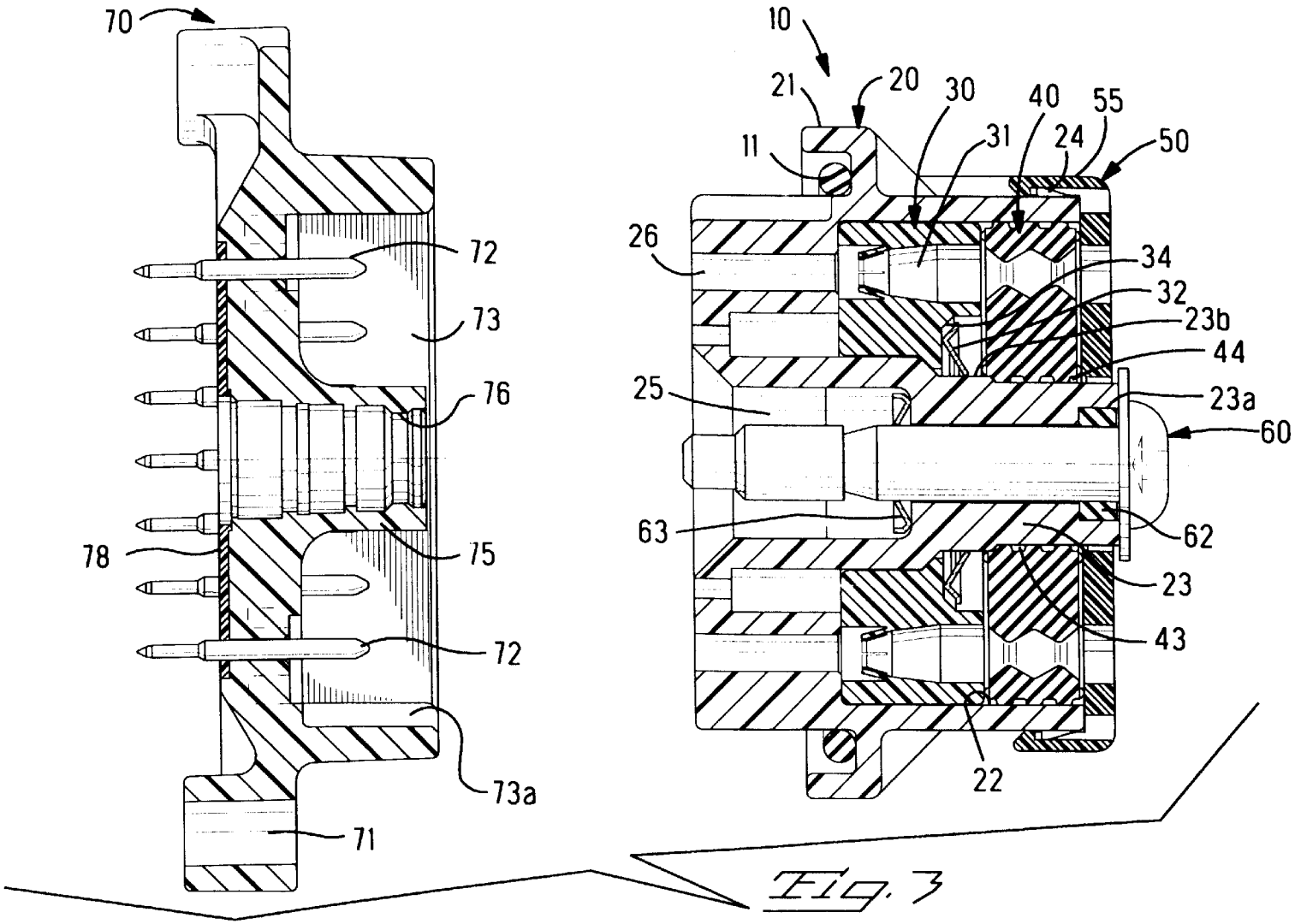
FIG. 3 shows a cross sectional view of the subassembly and header of FIG. 2 taken along line 3—3.
Figure 4:
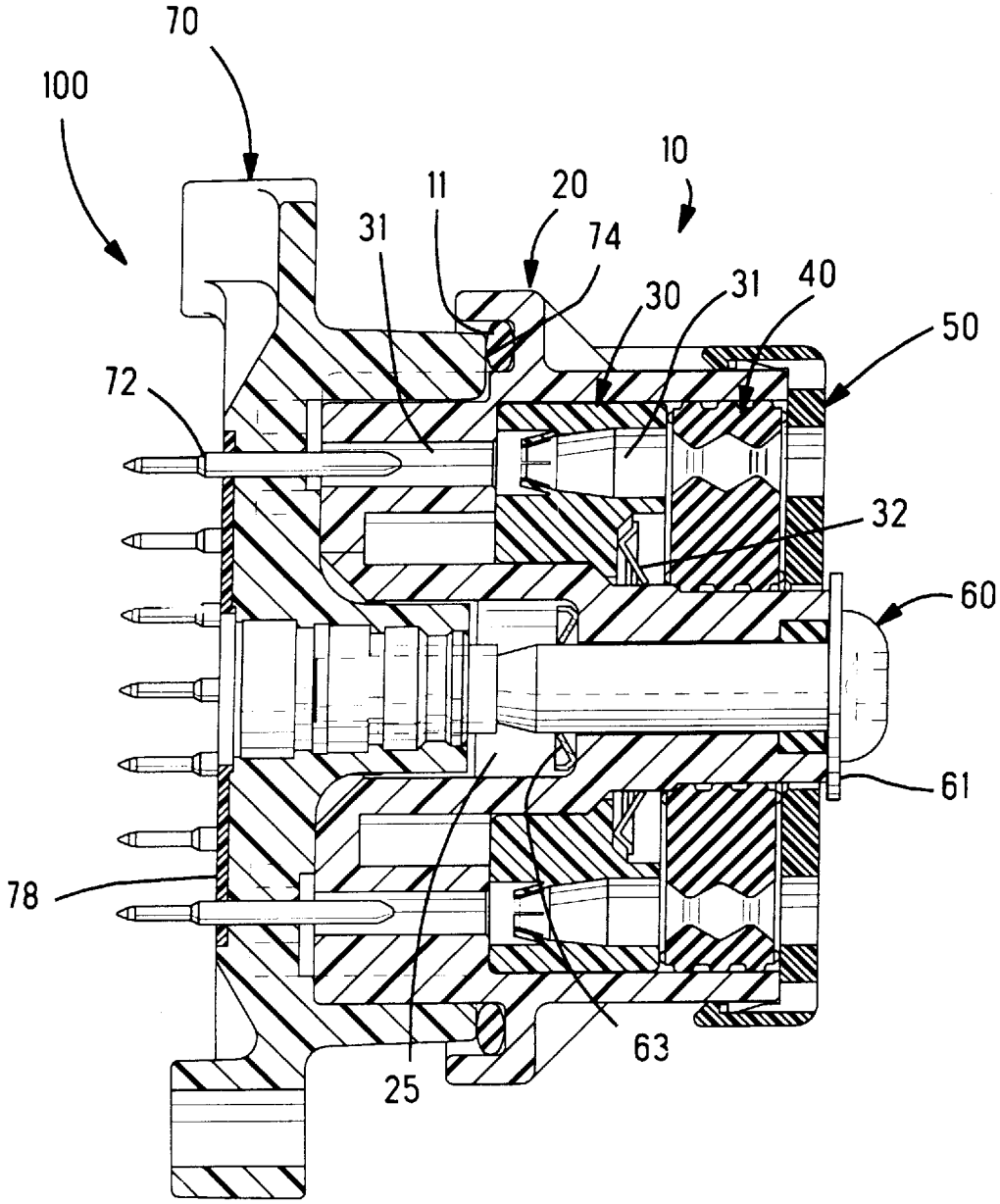
FIG. 4 shows a cross sectional view of the subassembly and header of FIG. 3 in a fully assembled state.

Referring to FIGS. 1–3, plug housing 20 includes: a seal receiving section 21 for receiving interface seal. 11; a contact retention insert receiving cavity 22; a bolt tower 23 having a seal recess 23*a* for receiving bolt seal 62 therein; a friction surface 23*b* for frictionally receiving insert retaining clip 32 thereon; detents 24 on an outer surface thereof for receiving latches formed on the seal cover 50; a mating recess 25 for receiving a portion of header 70 (see FIG. 4); and pin receiving apertures 26 for receiving pins 72 of header 70 (see FIG. 4). Additionally, a plurality of wire guide mounts 29 are formed on an outer surface of plug housing 20 for receiving latching legs 89 of wire guide 80 (see FIG. 7).

Now referring to FIGS. 1, 3, and 4, contact retention insert 30 will be described. Contact retention insert 30 includes: contact receiving apertures 31 having latching fingers for latchable engagement with respective electrical contacts to be inserted therein; an insert retaining clip 32 having detents for biting into frictional surface 23*b* of bolt tower 23, and which clip advantageously retains the insert 30 within the cavity 22 of plug housing 20; a bolt tower receiving aperture 33 for receiving bolt tower 23 therethrough; and an insert clip flange 34 for pressing engagement with the insert retaining clip 32.

Again referring to FIGS. 1, 3, and 4, wire seal 40 will be described. Seal 40 includes: contact receiving apertures 41;

a bolt tower receiving aperture 43 having undulated surfaces for sealingly receiving bolt tower 23 therethrough; and sealing void spaces 44 allowing the seal to accommodate the bolt tower 23. Contact receiving apertures 41 include undulated surfaces for sealing engagement with conductors terminated to electrical contacts to be inserted in insert 30.

Referring to FIGS. 1–3, seal cover 50 is latchably mounted to housing 20. Seal cover 50 includes: contact receiving apertures 51; a bolt tower receiving aperture 53 for receiving bolt tower 23 therethrough; and side latches 54 and top latches 55 for latchably engaging latching detents 24 of plug housing 20 thereby retaining seal 40 within housing 20. Wire guide recesses 59 are provided for receipt of latching wire guide mounts 29 of housing 20, as is shown best in FIG. 5.

FIGS. 1, 3, and 4 best show the details of jack screw 60. Jack screw 60, as installed in assembly 10, cooperates with: a washer 61; a seal 62; and a retaining clip 63 for rotatably retaining jackscrew 60 in the plug housing 20. The jack screw 60 is rotatably mounted on the plug housing 20 but is axially locked in place between washer 61 and retaining clip 63. Retaining clip 63 allows rotational movement of the jack screw 60 relative to plug housing 20, but resists any axial displacement of the jackscrew 60 relative to plug housing 20.

Referring now to FIGS. 2–5, header housing 70 will be described. Header housing 70 includes: a plurality of mounting holes 71 for receiving fasteners for the purpose of mounting housing 70 to a component surface (not shown in the drawings); pin array 72 for electrical connection to contacts to be inserted in subassembly 10; and a cavity 73 for matably receiving the subassembly 10 therein. Additionally, polarizing ribs 73*a* are formed in cavity 73 for requiring proper polarization of subassembly 10 relative to the pin array 72. Header housing 70 further includes: a sealing face 74, as best shown in FIG. 4, for sealing engagement with interface seal 11; and a tower 75 including a threaded insert 76 for threadable engagement with jack screw 60. FIG. 4 also shows a silicone-base, UV light cured sealant material 78 layered around the pin array 72 for providing a seal interface on the component side of header 70.

Figure 5:
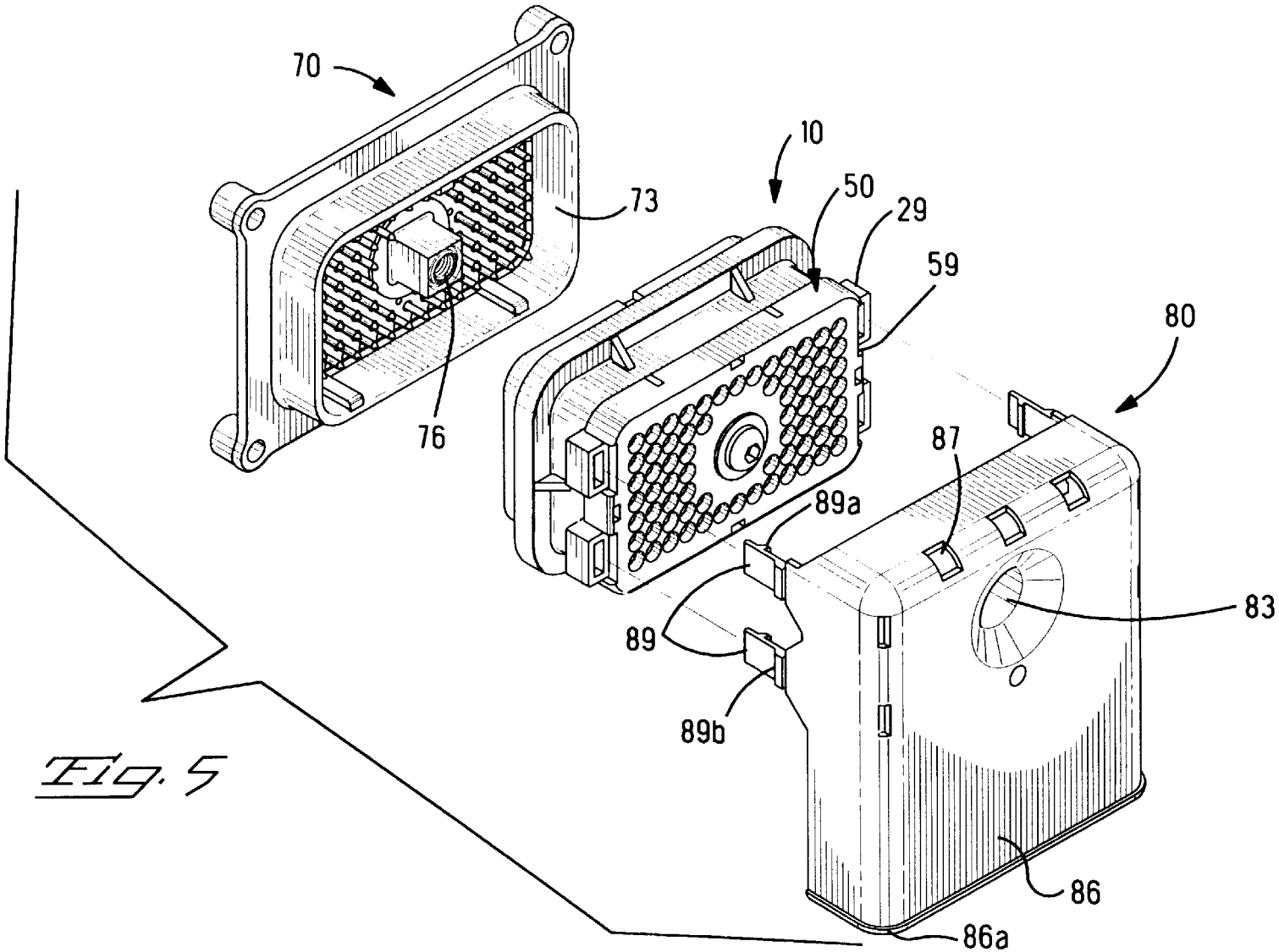
FIG. 5 shows an exploded isometric view of the subassembly and header of FIG. 2 with a wire guide member according to the present invention.
Figure 7:
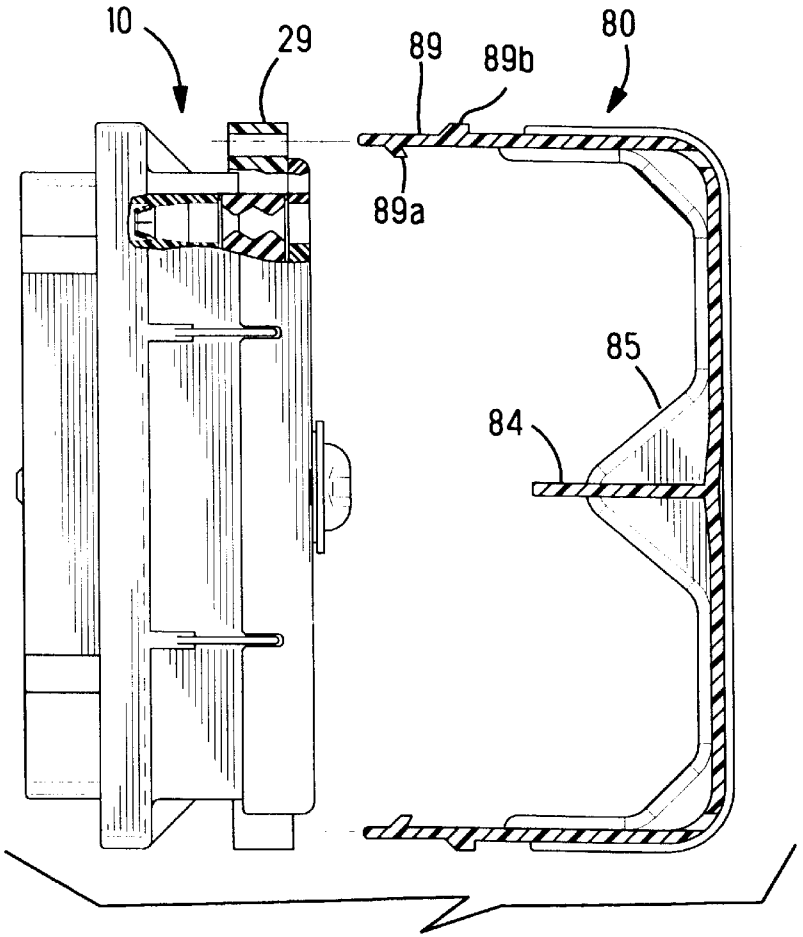
FIG. 7 shows a cross sectional view of the wire guide member of FIG. 6 arranged to be connected to the subassembly of the present invention.
Figure 6:
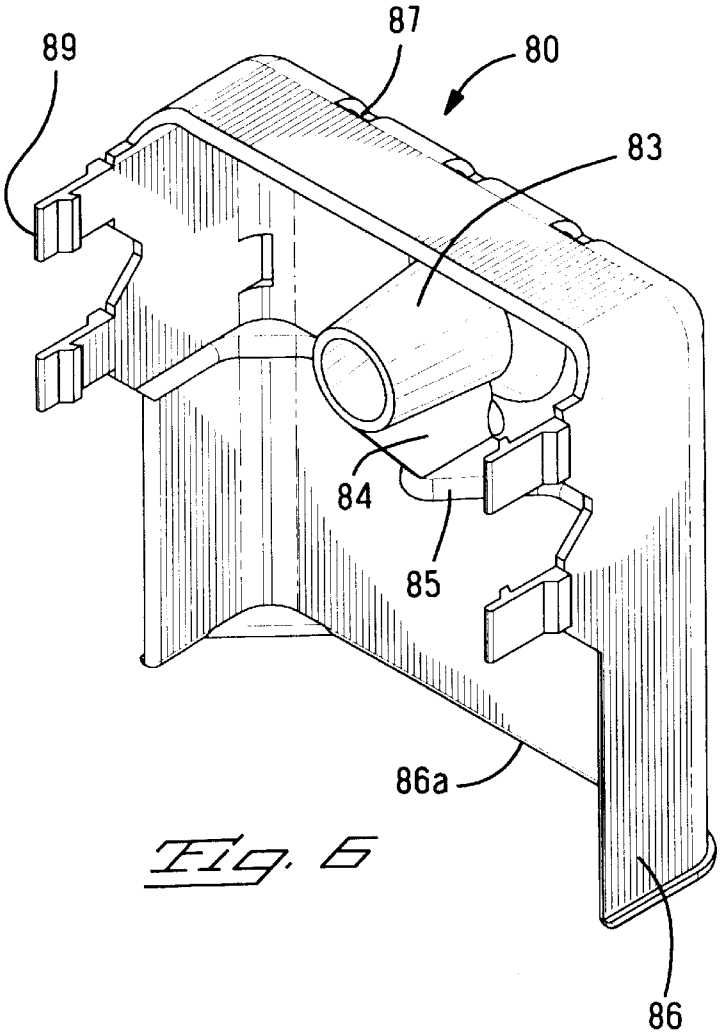
FIG. 6 shows an isometric view of the wire guide member of FIG. 5.

Referring to FIGS. 5–7, a wire guide 80 according to the present invention will be described. Wire guide 80 includes a bolt access tower 83 for a tool to have access to jack screw 60; and, as shown in FIGS. 6–7, wire guide 80 includes an intermediate reinforcement member 84 disposed between the tower 83 and a transverse reinforcement member 85. The reinforcement members serve the purpose of stiffening the wire guide 80, which stiffening is advantageous because the wire guide must pressingly guide a plurality of wires exiting from the subassembly 10 in order to minimize the space taken up by the wires in, for example, an engine compartment. Reinforcement members 84,85 thus prevent buckling of the wire guide due to the pressing and guiding of the wires. Additionally, wire guide 80 comprises a lower section 86 thereby defining an extension of wire guide 80 for: protecting wires extending toward, for example, a braid of a wiring harness; preserving wire identification; and avoiding abrasion of wires exiting subassembly 10 by virtue of an edge radius profile 86*a*. Through holes 87 are provided for drainage of moisture or other contaminants from the wiring harness.

Referring to FIG. 7, latching legs 89 include front lugs 89*a* and back lugs 89*b* for latching engagement with wire guide mounts 29 of plug housing 20. Installation of wire dress 80 requires that respective lugs 89*a* will be inserted through respective guide mounts 29 so that respective lugs 89*b* will make an interference fit with guide mounts 29. Removal of cover 80 from subassembly 10 requires deflection of lugs 89*a* away from subassembly 10 so that lugs 89*a* are positioned to be retracted through guide mounts 29, and then cover 80 is pulled away from subassembly 10.

FIG. 4 shows the overall mated assembly 100 without the wire guide 80. However, in a preferred embodiment with wire guide 80 installed on assembly 100, the wires will exit from the assembly 10 and will be generally oriented at a 90 degree angle relative to a mating axis of the subassembly 10.

Additionally, in the preferred embodiment of assembly 100, the contact retention insert 30 is inserted in cavity 22 of plug housing 20 and the insert retaining clip is pressed against the insert clip flange 34 so that the frictional detent members of insert retaining clip 32 will bite into the friction surface 23*b* of plug housing 20 thereby retaining the insert in the plug housing 20. It is notable, however, that friction surface 23*b* includes an outer diameter which is larger than the outer diameter of the bolt tower 23 adjacent to seal recess 23*a*, which facilitates installation of clip 32 as the inner diameter of the clip is sized to bite into only the larger diameter of surface 23*b*. Next, blanket-type wire seal 40 is inserted into cavity 22, and seal cover 50 is placed over the wire seal 40 so that latches 54,55 engage cover detents 24, cover 50 thereby retains the seal 40 in cavity 22.

Referring now to FIG. 4, an electrical contact (not shown) can be inserted into contact receiving aperture 31 so that the resilient fingers of aperture 31 will frictionally engage the electrical contact, and the pin array 72 will be aligned for electrical engagement with the contact. The operator then need only rotate jack screw 60 so that the header 70 will be drawn into mating engagement with subassembly 10. During this assembly step, electrical contacts in apertures 31 of subassembly 10 will be brought into electrical engagement with respective pins of contact pin array 72. With wires grouped accordingly, wire guide 80 will be aligned with the mated assembly 100, latching legs 89 of wire guide 80 will be inserted in wire guide mounts 29, and wire guide 80 will be pressed towards the mated assembly 100 thereby dressing the wires in a generally 90 degree angle relative to the mating axis of the mated assembly 100. As shown in FIG. 5, bolt access tower 83 of wire guide 80 will be aligned with jack screw 60 so that the operator may later have access for a tool to remove subassembly 10 from the header housing 70. An advantage of bolt access tower 83 is that jack screw 60, and bolt tower 23, need not be excessively long for tool access purposes, i.e. reach to the outer surface of the wire guide 80, because bolt access tower allows the tool to extend to the seal cover 50.

The foregoing invention: combines the advantages inherent in a blanket type seal 40 with a jack screw connector mating mechanism 60; securely retains electrical contacts in a contact retention insert 30; provides mechanical and electrical reliability of the electrical interconnections in the connector; and, by virtue of the retaining clip 32, is inexpensive to produce, and uses a minimum number of parts which can be quickly assembled with quality and reliability assured in the final assembly 100.

Thus, while a preferred embodiment of the invention has been disclosed, it is to be understood that the invention is not to be strictly limited to such embodiment, but may be otherwise variously embodied and practiced within the scope of the appended claims.

Accordingly, what is claimed is:

1. An electrical connector subassembly comprising:

an electrical connector having a wire exit side, a fastener accessible from the wire exit side, and said connector comprises opposed latch receiving lugs for receiving respective wire guide latches; and a wire guide having latches extending therefrom for respective latching engagement with said connector latch receiving lugs, said wire guide comprises a fastener access aperture for permitting operation of said fastener when said wire guide is mounted on said connector, said wire guide includes a transverse reinforcement section of said wire guide.

2. The subassembly of claim 1, wherein said aperture comprises a fastener access tower.

3. The subassembly of claim 1, wherein the fastener aperture is buttressed by the reinforcement section of said wire guide.

4. The subassembly of claim 1, wherein each said latch is deflected as it registers with a respective said latch receiving lug.

5. The subassembly of claim 1, wherein each said latch comprises respective inner and outer latching projections for latching registration with a respective said latch receiving lug.

6. The subassembly of claim 2, wherein said fastener access tower comprises a generally conical shape.

7. The subassembly of claim 1, wherein said connector comprises a cover member with notches formed adjacent to said latch receiving lugs.

8. The assembly of claim 7, wherein said latches pass into said lugs adjacent said notches.

9. An electrical connector subassembly comprising:

an electrical connector having a wire exit side, a fastener accessible from the wire exit side, and said connector comprises opposed latch receiving lugs for receiving respective wire guide latches; and a wire guide having (a) an upper section, said upper section comprises latches extending therefrom for respective latching engagement with said connector latch receiving lugs, and a fastener access aperture for permitting operation of said fastener when said wire guide is mounted on said connector, and (b) a lower section, said lower section comprises a wire protecting section which extends laterally of said electrical connector for protecting wires adjacent to said electrical connector, wherein said wire guide comprises a reinforcement member intermediate said upper and lower sections for stiffening said wire guide.

10. The subassembly of claim 9, wherein said wire guide comprises the reinforcement member intermediate said upper and lower sections for stiffening said wire guide.

11. The subassembly of claim 9, wherein a second reinforcement member is integral with said reinforcement member for stiffening said wire guide.

12. The subassembly of claim 9, wherein said upper section comprises at least one hole therethrough for allowing a fluid to drain away from said subassembly.

13. An electrical connector subassembly comprising:

an electrical connector having a wire exit side, a fastener accessible from the wire exit side, and said connector comprises opposed latch receiving lugs for receiving respective wire guide latches; and a wire guide having latches extending therefrom for respective latching engagement with said connector latch receiving lugs, said wire guide comprises a fastener access aperture for permitting operation of said fastener when said wire guide is mounted on said connector, the fastener aperture is buttressed by a reinforcement section of said wire guide.

14. An electrical connector subassembly comprising:

an electrical connector having a wire exit side, a fastener accessible from the wire exit side, and said connector comprises opposed latch receiving lugs for receiving respective wire guide latches; and a wire guide having latches extending therefrom for respective latching engagement with said connector latch receiving lugs, said wire guide comprises a fastener access aperture for permitting operation of said fastener when said wire guide is mounted on said connector, wherein each said latch comprises respective inner and outer latching projections for latching registration with a respective said latch receiving lug.

15. The subassembly of claim 14, wherein said fastener access tower comprises a generally conical shape.

16. An electrical connector subassembly comprising:

an electrical connector having a wire exit side, a fastener accessible from the wire exit side, and said connector comprises opposed latch receiving lugs for receiving respective wire guide latches; and a wire guide having (a) an upper section, said upper section comprises latches extending therefrom for respective latching engagement with said connector latch receiving lugs, and a fastener access aperture for permitting operation of said fastener when said wire guide is mounted on said connector, said fastener access aperture comprises a tower structure and said tower structure includes a first reinforcement member extending therefrom for stiffening said wire guide, and (b) a lower section, said lower section comprises a wire protecting section which extends laterally of said electrical connector for protecting wires adjacent to said electrical connector.

17. The subassembly of claim 16, wherein a second reinforcement member is integral with said first reinforcement member for stiffening said wire guide.

18. An electrical connector subassembly comprising:

an electrical connector having a wire exit side, a fastener accessible from the wire exit side, and said connector comprises opposed latch receiving lugs for receiving respective wire guide latches; and a wire guide having (a) an upper section, said upper section comprises latches extending therefrom for respective latching engagement with said connector latch receiving lugs, and a fastener access aperture for permitting operation of said fastener when said wire guide is mounted on said connector, said upper section includes at least one hole therethrough for allowing a fluid to drain away from said subassembly, and (b) a lower section, said lower section comprises a wire protecting section which extends laterally of said electrical connector for protecting wires adjacent to said electrical connector.

* * * * *